US005759304A

United States Patent [19]

Kluge

[11] Patent Number: 5,759,304

[45] Date of Patent: Jun. 2, 1998

[54] PROCESS FOR PRODUCING HOT ROLLED STEEL STRIP WITH ADJUSTED STRENGTH

[75] Inventor: Ehrhard Kluge, Neunkirchen, Germany

[73] Assignee: Rexnord Kette GmbH & Co. KG, Betzdorf, Germany

[21] Appl. No.: 185,533

[22] Filed: Jan. 21, 1994

[30] Foreign Application Priority Data

Jan. 23, 1993 [DE] Germany ..... 43 01 754.1

[51] Int. Cl.[6] ..... C21D 6/00; C21D 8/02; C22C 38/40

[52] U.S. Cl. ..... 148/504; 148/608; 148/610

[58] Field of Search ..... 148/504, 608, 148/610

[56] References Cited

U.S. PATENT DOCUMENTS

| | | | |
|---|---|---|---|
| 4,824,491 | 4/1989 | Tanaka et al. | 148/12 C |
| 5,131,960 | 7/1992 | Kluge | 148/608 |

FOREIGN PATENT DOCUMENTS

| | | |
|---|---|---|
| 3105891 | 9/1982 | Germany . |
| 3925047 | 1/1991 | Germany . |
| 1 543 864 | 4/1979 | United Kingdom . |
| 2051859 | 1/1981 | United Kingdom . |

*Primary Examiner*—Sikyin Ip

*Attorney, Agent, or Firm*—Bell Seltzer Intellectual Property Law Group; Alston & Bird LLP

[57] ABSTRACT

In a process for producing hot rolled steel strip with adjusted strength a steel with 0.04 to 0.06% carbon, at most 1% silicon, at most 1% manganese, 13 to 18% chromium, at most 2% nickel, balance carbide formers and iron, inclusive of impurities due to melting, is melted, the actual content of carbide formers within the specified limits is determined, a rolling oversize for a subsequent hot rolling is established in dependence on the actual content of carbide formers, and the hot rolled strip is solution annealed at a temperature of 920° to 1050° C. and quenched to a ferritic-martensitic structure and cold rolled down to the specified final thickness.

7 Claims, 3 Drawing Sheets

PROCESS FOR PRODUCING HOT ROLLED STEEL STRIP WITH ADJUSTED STRENGTH

TECHNICAL FIELD OF THE INVENTION

The invention relates to the production of hot rolled steel strip, particularly for use for the fabrication of conveyor chains.

BACKGROUND OF THE INVENTION AND PRIOR ART

Owing to their lower price compared with austenitic nickel chromium steels and their high strength together with adequate ductility, ferritic chromium steels have proved their worth in many respects. In particular they are useful as material for flat-top chains such as are used for apron conveyors for goods that are susceptible to contamination and are corrosive, for example in beverage filling plant.

The chains and their plate members must be resistant to wear and fracture, but must also possess sufficient cold workability to allow blanks of flat material to be provided, by cold curling of correspondingly shaped flaps, and which also include hinge eyes to receive hinge pins connecting respective pairs of adjacent plates.

Since such flat-top chains are subjected in service to high mechanical stress and corrosive attack, the selection and treatment of the material are of decisive importance. This involves adjusting the mechanical properties such as the yield point, hardness and fatigue strength of a material—usually steel—having sufficient corrosion resistance as exactly and isotropically as possible in order on the one hand to avoid difficulties in working it to form plate members and on the other hand to ensure optimal performance in service.

A ferritic-pearlitic steel containing 0.1% carbon, up to 1% silicon, up to 1% manganese, 13.0 to 15.8% chromium, 0.8 to 3.0% nickel, up to 1.5% molybdenum, up to 0.6% titanium, balance iron and usual incidental elements, with the proviso that the total content of chromium and molybdenum amounts to at most 14.3%, is known from German Offenlegungsschrift 31 05 891. After a conventional cold rolling and annealing this steel is cold finish rolled with 10 to 25% deformation, and in this way given a 0.2% proof stress of 600 to 700 N/mm$^2$, an ultimate tensile stress of 650 to 750 N/mm$^2$ and an elongation to fracture of 7 to 12%; it can be hard drawn to a strength of at least 1000 N/mm$^2$.

Furthermore German Offenlegungsschrift 39 36 072, which is hereby incorporated by reference, describes a stainless ferritic-martensitic chromium steel containing 0.03 to 0.07% carbon, at most 1% silicon, at most 1% manganese, 13 to 18% chromium and at most 2% nickel, the balance being iron and impurities arising from melting, which as hot rolled strip after a solution anneal and quenching to a ferritic-martensitic two-phase structure with for example 50% martensite has, as a result of a very small grain size, an ultimate tensile stress of at least 800 N/mm$^2$, a hardness of about 105 to 107 Rockwell B and a high toughness, which permits free bending with a bending radius down to 0 in the bend test.

In the case of this known chromium steel it is of particular advantage that the above-mentioned combination of properties can be obtained without cold rolling, although a final cold rolling with a small degree of deformation, for example a reduction in thickness of up to 10%, is found to be advantageous.

Although the steel of the above-mentioned composition treated in the above-mentioned way has proved extremely satisfactory in practice, from the point of view of optimization it lacks a sufficient degree of accuracy in respect both of working and of performance in service.

What is decisive both for working and for performance in service is the tolerance within which the desired final thickness and the specified strength can be obtained, since variations in these two critical quantities lead to difficulties in further working of the strip, for example by stamping and forming, and in the use of the finished parts. Thus for example the plate members of a flat-top chain, such as those known from the German Offenlegungsschrift 39 36 072, are made by first stamping out blanks from the hot rolled strip, optionally after additional cold rolling of the strip with a small reduction in thickness. The blanks have two flaps on one side and one flap on the opposite side. These flaps are curled to form hinge eyes and in so doing undergo a considerable amount of cold work, which if the strength is too high and the toughness correspondingly lower can lead to edge cracking and orange peel effect. Moreover, depending on the strength, spring-back of the curled flaps can occur. This spring-back is the stronger the higher the strength, and there is no way of compensating for it, since the strength of the material is not constant. This results not only in differences in plate dimensions along the chain or in the direction of transport, but also in the centre lines of the eyes no longer lying at the same height relative to the plane of the plate, and in addition in differences in eye diameter.

All this leads to impaired service performance, for the variation in dimensions of the chain members of for example up to 10 mm/m add up over the length of the chain to considerable amounts which can lead to the chain no longer meeting the standard, which prescribes a length tolerance of at most 0.4%. Different centre lines of the hinge eyes on the other hand lead to the plate concerned taking up a skewed position in the chain or its guides in service, which leads to malfunctioning, for example to bottles falling over in filling plant. In view of the extraordinarily high filling rates such malfunctions are associated with substantial costs and also with contamination of the conveyor concerned by spillage of the charge material.

A further disadvantage associated with the uncontrollable spring-back of the eye flaps is that this results in differences in eye diameter, depending on the extent of the spring-back: when the diameter is too small it is not possible to accommodate the hinge pins in the two outer hinge eyes, while if the diameter is too great the hinge pins have too much play. This play, too, can add up over the length of the chain to an unacceptable deviation from the standard size, and moreover it causes increased wear and additional noise nuisance in service.

In stamping, both the tool life and the quality of the stamped blank depends on the strength, for the gap between the punch and the die must, as is known, correspond to the strength of the material. Unless this is so, stamping without flashes or burrs is not possible. Consequently if there is a variation in strength of more than±50N/mm$^2$ a time-consuming and costly adjustment of the stamping tool is necessary.

OBJECT OF THE INVENTION

The object of the invention is therefore to further develop the teaching of German Offenlegungsschrift 39 36 072 so that the strength of the steel strip can be adjusted to the critical value for the working and service performance within a small tolerance, or be corrected by simple means.

THE INVENTION

This object is achieved on the basis of the discovery that in a ferritic-martensitic steel what determines the proportion of martensite, and thus the strength of the heat treated steel, is the content of free carbon. This however can never be precisely adjusted in the presence of carbide formers, since the usual carbide formers react not only with the carbon but also with the oxygen and nitrogen present in every steel melt. According to the oxygen and the nitrogen contents of the melt, different amounts of carbide formers are therefore available for carbide formation. Accordingly the amount of carbide, and thus the content of free carbon, depends not only on the amount of carbide formers but also on the contents of oxygen and nitrogen. This leads to corresponding fluctuations in the final strength after hot rolling, solution annealing and quenching to a ferritic-martensitic two-phase structure.

The invention counters this by rolling in the hot rolling step to a thickness defined by the final desired thickness plus a certain oversize which provides a reserve of thickness which makes a subsequent cold rolling necessary. By means of this cold rolling the final strength can then be very precisely adjusted to the specified value.

The oversize necessary in any particular case depends on the nature of the respective carbide former and can be determined by simple tests in which the relationship between the actual content of carbide former or—with more difficulty—the content of free carbon within the specified limits and the reduction in thickness on cold rolling needed for the desired final strength is established. There is a substantially linear relationship between the content of carbide former and the necessary reduction in thickness and the oversize corresponding thereto.

Specifically, the solution of the above-mentioned problem consists in a process for producing steel strip with adjusted strength, wherein a steel with

| | |
|---|---|
| carbon | 0.04 to 0.06% |
| silicon | 1% max. |
| manganese | 1% max. |
| chromium | 13 to 18% |
| nickel | 2% max. |
| balance carbide formers and iron inclusive of impurities arising from melting | |

is melted; the actual content of carbide formers or the content of free carbon within the specified limits is determined; the rolling oversize for the subsequent hot rolling is established in dependence on the actual content of carbide former or of carbon; the strip is annealed after the hot rolling at a temperature of 920° to 1050° C. and quenched to a ferritic-martensitic structure and cold rolled to the specified final thickness. The duration of annealing preferably amounts to 10 to 60 minutes, for example 15 to 30 minutes.

The thickness of the hot rolled strip includes the oversize resulting from the actual content of carbide formers or of free carbon that on cold rolling to the final thickness brings with it the work hardening required to achieve the desired final strength.

Thus in the process according to the invention the oversize also varies with the content of free carbon or carbide formers within the specified limits, and correspondingly also the reduction in thickness on cold rolling, which alone serves to compensate for the oversize and to adjust the strength, despite analytical fluctuations, to a constant value. The cold rolling therefore serves for correction of the strength in dependence on analysis in the case of a hot rolled strip.

Should deviations from the intended thickness (final thickness plus oversize) established in dependence on the content of carbide formers occur on hot rolling, there is a further possible means of correction according to another aspect of the invention in which, the actual thickness of the hot rolled strip is measured after the hot rolling and the hot rolled strip is then annealed using a temperature dependent on the deviation in thickness and is then quenched in the manner mentioned above and cold rolled to the specified final thickness.

In this way it is possible, by a purposive adjustment of the oversize on hot rolling for each individual charge and a solution annealing—optionally at an annealing temperature selected within a specified temperature range in dependence on the deviation in thickness of the hot rolled strip—to provide starting conditions for the subsequent cold rolling to the final thickness which permit adjustment to the desired final strength, by way of measured work hardening, with high precision, at least with a tolerance of $\pm 50 N/mm^2$.

If, for example, the steel contains 0.25 to 0.35% titanium, the rolling oversize in millimeters is calculated by the following equation:

$$OS=6.5 \cdot Ti-1.4$$

and the annealing temperature as a function of the thickness deviation on hot rolling by the equation:

$$T \text{ (in °C.)}=-375 \cdot D+1050.$$

In the two equations OS signifies the hot rolling oversize that corresponds to the reduction in thickness on cold rolling, D the thickness deviation (deviation from the intended thickness, which corresponds to the final thickness plus the oversize), T the annealing temperature and Ti the percentage content of titanium.

Similar equations can readily be determined for other carbide formers such as tungsten, molybdenum, vanadium, titanium, niobium and tantalum as will be apparent to the skilled artisan.

A steel of such a composition treated in this way is particularly suitable as material for flat-top or roller chains.

The invention thus makes use of the discovery that between the content of free carbon or the carbide former content, the reduction in thickness on cold rolling and the annealing temperature on the one hand and the final strength on the other hand there is a relationship which permits the desired strength to be consistently obtained even if—for whatever reason—fluctuations in the content of carbide former within the specified limits should occur. The adjustment of the strength in accordance with the invention by means of the analysis-controlled reduction in thickness on cold rolling in dependence on the actual carbide former content and optionally also by means of the solution annealing temperature in dependence on the actual reduction in thickness on cold rolling (corresponding to the actual oversize) thus avoids scrap batches being made and gives a material which is characterized by a very fine grain structure, a high proof stress, a strength that is constant from charge to charge, a high cold workability and almost identical mechanical properties in the longitudinal and transverse directions.

Accordingly material from different charges does not need to be kept apart. The high uniformity of the properties of the material permits problem-free further processing without adjustment of the tools when stamping the blanks for the plate members. Moreover the number of material tests and accordingly also the amount of test scrap associated therewith is considerably reduced and chains of uniform length and high flatness are obtained. This leads in service to trouble-free and quiet running with low lubricant consumption and long service life with high carrying capacity.

The steel for the process of the invention preferably contains at most 0.035% phosphorus, at most 0.025% sulphur, 0.02 to 0.04% nitrogen with at least 0.04% carbon and nitrogen.

BRIEF DESCRIPTION OF THE DRAWINGS

The invention will now be described in more detail with reference to the accompanying drawings, in which.

DETAILED DESCRIPTION OF PREFERRED EMBODIMENTS OF THE INVENTION

Figure 1:
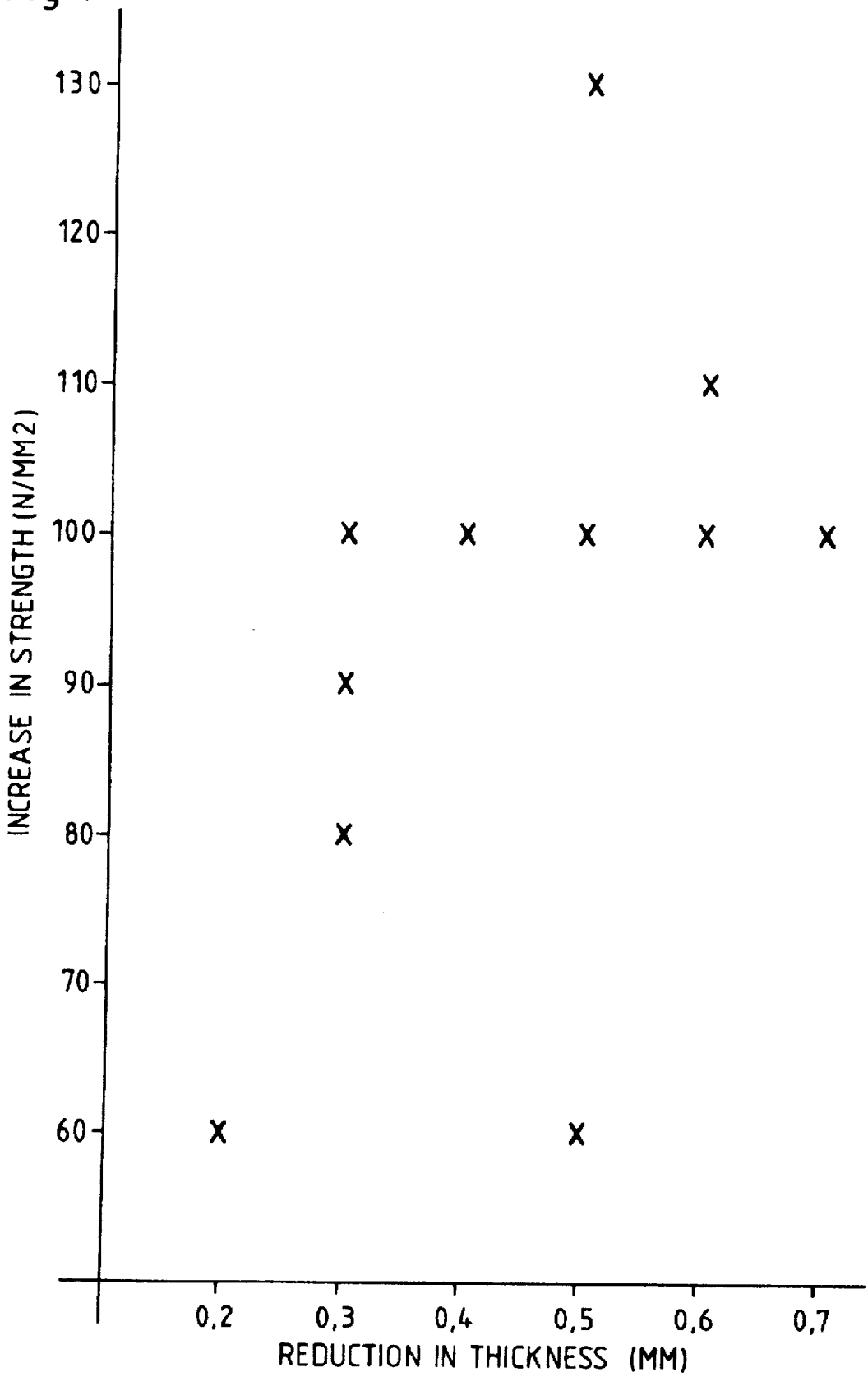
FIG. 1 is a graph of the increase in strength as a function of the reduction in thickness on cold rolling for steels having a composition in accordance with the invention.

As can be seen from the diagram of FIG. 1, in a steel having a composition in accordance with the invention and hot rolled and heat treated in conventional manner, i.e. non-specifically, there is no connection between the reduction in thickness on subsequent cold rolling and the increase in strength associated therewith. Thus without taking account of the actual titanium content within the permitted range of 0.25 to 0.35% there are, for example, in the case of a reduction in thickness of 0.3 mm on cold rolling, three different increases in strength, namely of 80, 90 and 100N/$mm^2$, while an increase in strength of 100N/$mm^2$ can be obtained with thickness reductions of 0.3 to 0.7 mm.

Figure 2:
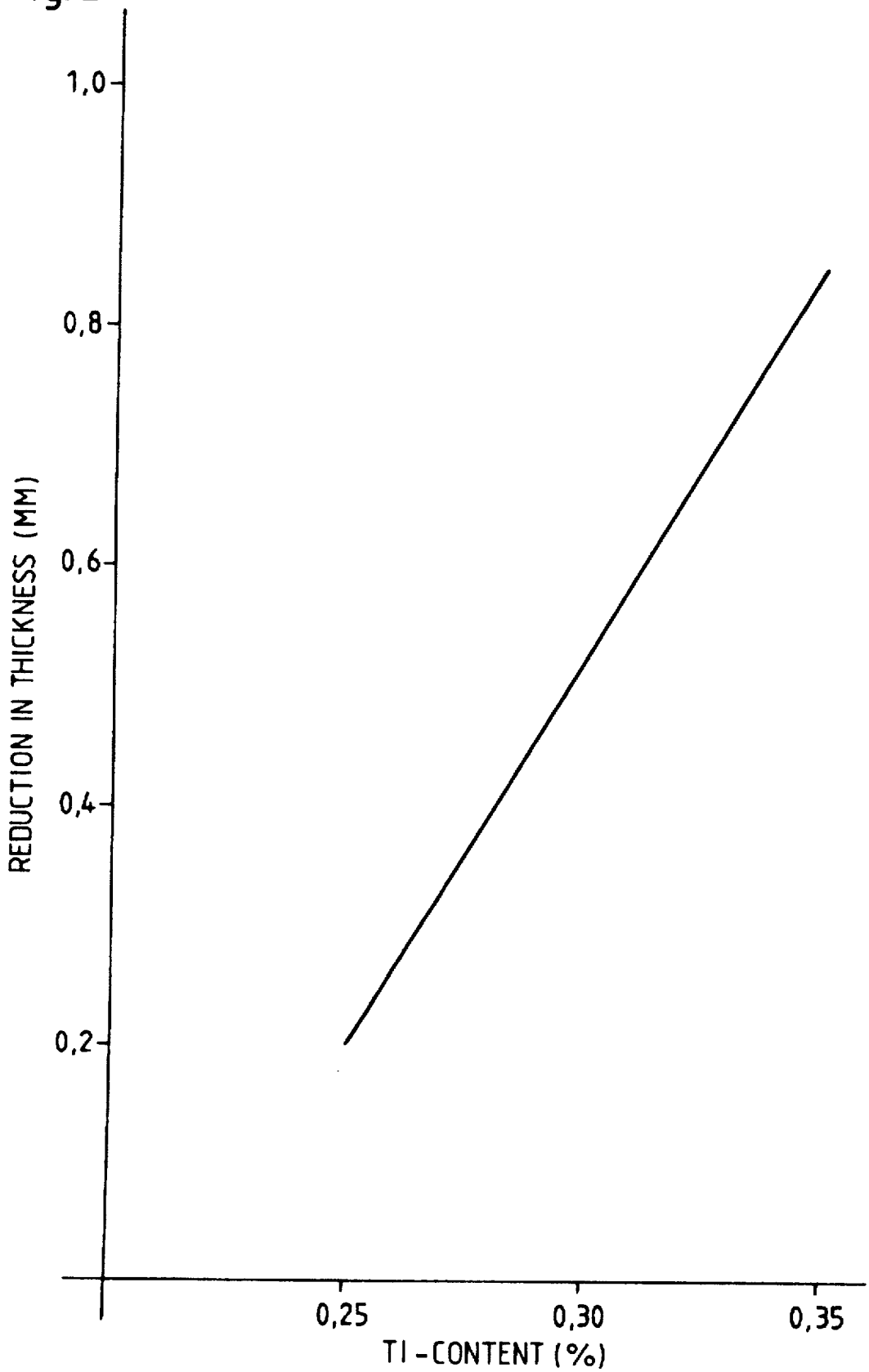
FIG. 2 shows the connection between the titanium content of the finished steel and the oversize required on hot rolling or the reduction in thickness required on corrective cold rolling.
Figure 3:
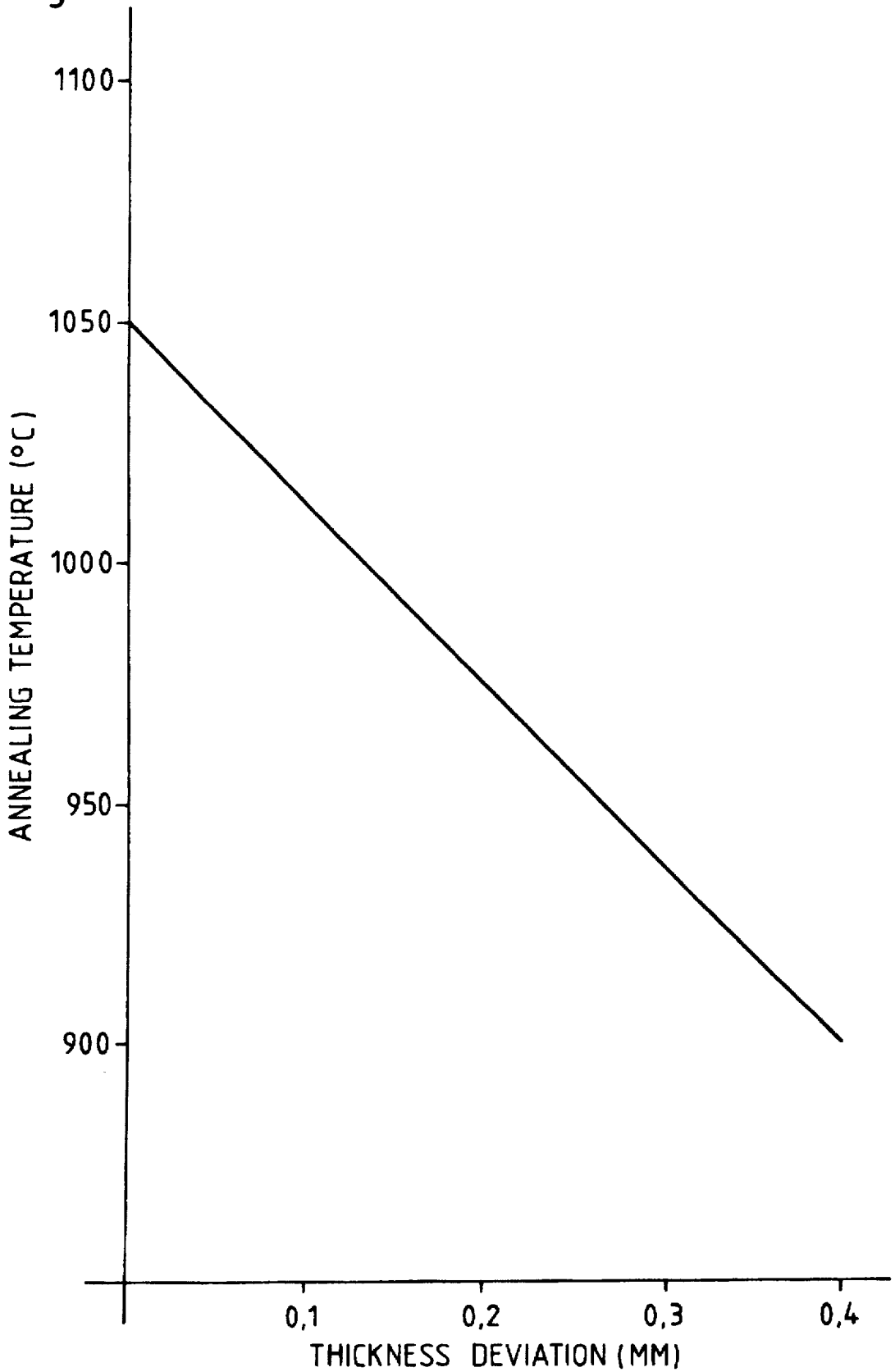
FIG. 3 is the solution annealing temperature required as a function of deviations in thickness of the hot rolled strip.

In contrast to this, in the case of the steel of the invention with its titanium content in the 0.25 to 0.35% region the same strength is always obtained if the reduction in thickness on cold rolling is adjusted by means of the actual titanium content of the finished steel on the basis of FIG. 2 and optionally the annealing temperature used for the solution annealing is adjusted in accordance with FIG. 3. The reduction in thickness and the annealing temperature need not be precisely adhered to: deviations of±25° C. and±0.10 mm are possible without any significant change in the strength resulting.

Accordingly the process of the invention permits correction of strength both on solution annealing and on cold rolling. By means of the process of the invention the same strength can therefore always be obtained, irrespective of the titanium content within the limits of 0.25 to 0.35% according to the invention. It follows from this that in melting the steel only these composition limits need be complied with; the actual titanium content does not matter, since adjustment to the desired uniform final strength can be effected on cold rolling on the basis of the actual titanium content. Deviations in thickness on hot rolling can in addition be compensated by the selection of the annealing temperature within the specified range of about 920° C. to 1050° C.

What is claimed is:

1. A process for producing hot rolled steel strip with adjusted strength comprising the steps;

melting a steel having the composition , 0.04 to 0.06% carbon, at most 1% silicon, at most 1% manganese, 13 to 18% chromium, at most 2% nickel, 0.25 to 0.35% titanium and balance being iron inclusive of impurities resulting from melting;

determining the content of titanium of said melted steel;

calculating a rolling oversize in response to said determining step;

hot rolling said steel that was melted in said melting step to produce a hot rolled strip having a first thickness corresponding to a predetermined final thickness increased by said rolling oversize;

solution annealing said hot rolled strip at a temperature of 920° to 1050° C. to produce an annealed strip;

quenching said annealed strip to a ferritic-martensitic structure to produce a quenched strip; and cold rolling said quenched strip to said final thickness.

2. The process according to claim 1, further comprising measuring the actual thickness of the hot rolled strip and adjusting the temperature of said solution annealing step to a predetermined adjusted temperature within said temperature range of 920° to 1050° C. determined based on a thickness deviation between said first thickness and said actual thickness.

3. Process according to claim 1, wherein said rolling oversize is determined in said calculating step according to the equation:

rolling oversize$=6.5\cdot Ti-1.4$.

4. Process according to claim 2, wherein the predetermined adjusted temperature is determined according to the equation:

$$T=-375\cdot D+1050$$

wherein D is the thickness deviation and T is the predetermined adjusted temperature in °C.

5. Process according to claim 1, wherein said composition of said steel melt comrises:

at most 0.035% phosphorus at most 0.025% sulphur 0.02 to 0.04% nitrogen, and at least 0.04% carbon and nitrogen.

6. The process of producing a flat top chain or roller chain comprising forming cold rolled strip produced by the process claimed in claim 1 into said flat top chain or roller chain.

7. A flat-top or roller chain made of steel strip produced by the process claimed in claim 1.

* * * * *